US005183322A

United States Patent [19]

Haruch

[11] Patent Number: 5,183,322

[45] Date of Patent: Feb. 2, 1993

[54] SPRAY GUN WITH SELECTIVE HYDRAULIC AND AIR ASSISTED OPERATING MODES

[75] Inventor: James Haruch, Naperville, Ill.

[73] Assignee: Spraying Systems Co., Wheaton, Ill.

[21] Appl. No.: 688,907

[22] Filed: Apr. 19, 1991

[51] Int. Cl.[5] ..... B05B 7/12; B05B 9/01; B05B 1/16

[52] U.S. Cl. ..... 239/394; 239/397; 239/416; 239/526

[58] Field of Search ..... 239/391, 392, 394, 397, 239/416, 416.2, 417.3, 456, 459, 530, 526, 527, 528

[56] References Cited

U.S. PATENT DOCUMENTS

| | | | |
|---|---|---|---|
| 1,159,015 | 11/1915 | Gibbs | 239/456 |
| 1,825,864 | 10/1931 | Harter | 239/526 X |
| 2,635,010 | 4/1953 | Sanders et al. | 239/526 X |
| 2,893,645 | 7/1959 | Johnson | 239/416 X |
| 3,385,524 | 5/1968 | Wahlin | 239/526 X |
| 3,637,142 | 1/1972 | Gassaway | 239/394 |
| 4,099,673 | 7/1978 | Heath et al. | 239/416 X |
| 4,314,671 | 2/1982 | Briar | 239/530 X |
| 4,361,283 | 11/1982 | Hetherington | 239/432 X |
| 4,541,568 | 9/1985 | Lichfield | 239/526 X |
| 4,619,403 | 10/1986 | Goldney et al. | 239/526 X |
| 4,702,420 | 10/1987 | Rath | 239/391 |
| 4,909,443 | 3/1990 | Takagi | 239/526 X |
| 5,020,727 | 6/1991 | Smith | 239/526 |

*Primary Examiner*—Andres Kashnikow
*Assistant Examiner*—William Grant
*Attorney, Agent, or Firm*—Leydig, Voit & Mayer

[57] ABSTRACT

A hand-held spray gun including a handle section, a barrel section mounted forwardly of the handle section, and a nozzle section mounted forwardly of the barrel section. The handle section has a liquid inlet at a rearward end thereof and is adapted to direct pressurized liquid in a straight longitudinal path through a relatively inexpensive plastic tube which functions both as a liquid conduit and as a mechanism for moving a valve follower of the gun between open and closed conditions in response to actuation of a trigger. The handle section further has a pressurized air inlet which communicates with the nozzle section through an air passageway defined between the liquid conduit tube and a barrel section housing for facilitating liquid atomization of the spray discharge. The nozzle tip has a multiplicity of spray orifices which are selectively locatable into operative position and at least some of which include an annular sealing member such that upon positioning of the spray orifice into operative position the associated sealing member blocks communication of pressurized air, enabling the gun to be operated in a purely hydraulic, non air assisted, spray mode.

45 Claims, 4 Drawing Sheets

LIQUID
AIR

SPRAY GUN WITH SELECTIVE HYDRAULIC AND AIR ASSISTED OPERATING MODES

FIELD OF THE INVENTION

The present invention relates generally to hand-held liquid spray guns, and more particularly, to spray guns which are operable with a plurality of selectively usable spray tip orifices and which may be operated in both air assisted and purely hydraulic spraying modes.

BACKGROUND OF THE INVENTION

Spray guns of such type have particular utility in the spraying of liquid chemicals, such as pesticides. It is common for the liquid supply for the spray gun to be manually carried in a pressurized container to which the spray gun is coupled. The container either may be an aerosol-type or may be manually pressurized by hand pumping. Since the tank air is used both as a propellant and as an air atomizing means, it is desirable that the gun be operated at as low of pressure as possible in order to conserve air pressure and minimize the extent of manual repumping of the tank. Since such spray guns must include both liquid and air porting, as well as actuating mechanisms for controlling operation of the gun in both hydraulic and air assisted spraying modes, heretofore spray guns of this type have been relatively complex and expensive in construction. Due to such complexity, such spray guns also have not lent themselves to easy disassembly for field service, repair or reconfiguration for the particular spray applications if desired. The spray discharges from such prior spray guns further tend to deteriorate in the air assisted spray mode at tank pressures below about 10 psi so as to necessitate frequent repumping of manual pumps or exchange of aerosol containers.

OBJECT AND SUMMARY OF THE INVENTION

It is an object of the present invention to provide a hand-held spray gun which may be operated in either air assisted or purely hydraulic spraying modes and which has a relatively simple, streamlined and easy to use configuration.

Another object is to provide a spray gun as characterized above which is operable for effective spraying at relatively low pressures so as to minimize repressurization of the liquid containing pressure tank with which the gun is used.

A further object is to provide a spray gun of the foregoing type which has a more simplified design, with the liquid supply being connected to a rear of the gun for directing liquid in a straight longitudinal path through the gun. A related object is to provide a spray gun of such type that has a relatively inexpensive tube, such as plastic tubing, which serves both as a conduit for liquid transfer through the gun and a means for moving the valve mechanism of the gun between open and closed positions in response to actuation and deactuation of an operating trigger.

Yet another object is to provide a spray gun of the above kind which lends itself to economical manufacture and relatively easy field disassembly, service and reconfiguration, if desired.

Other objects and advantages of the invention will become apparent upon reading the following detailed description and upon reference to the drawings, in which:

Figures 1, 2:
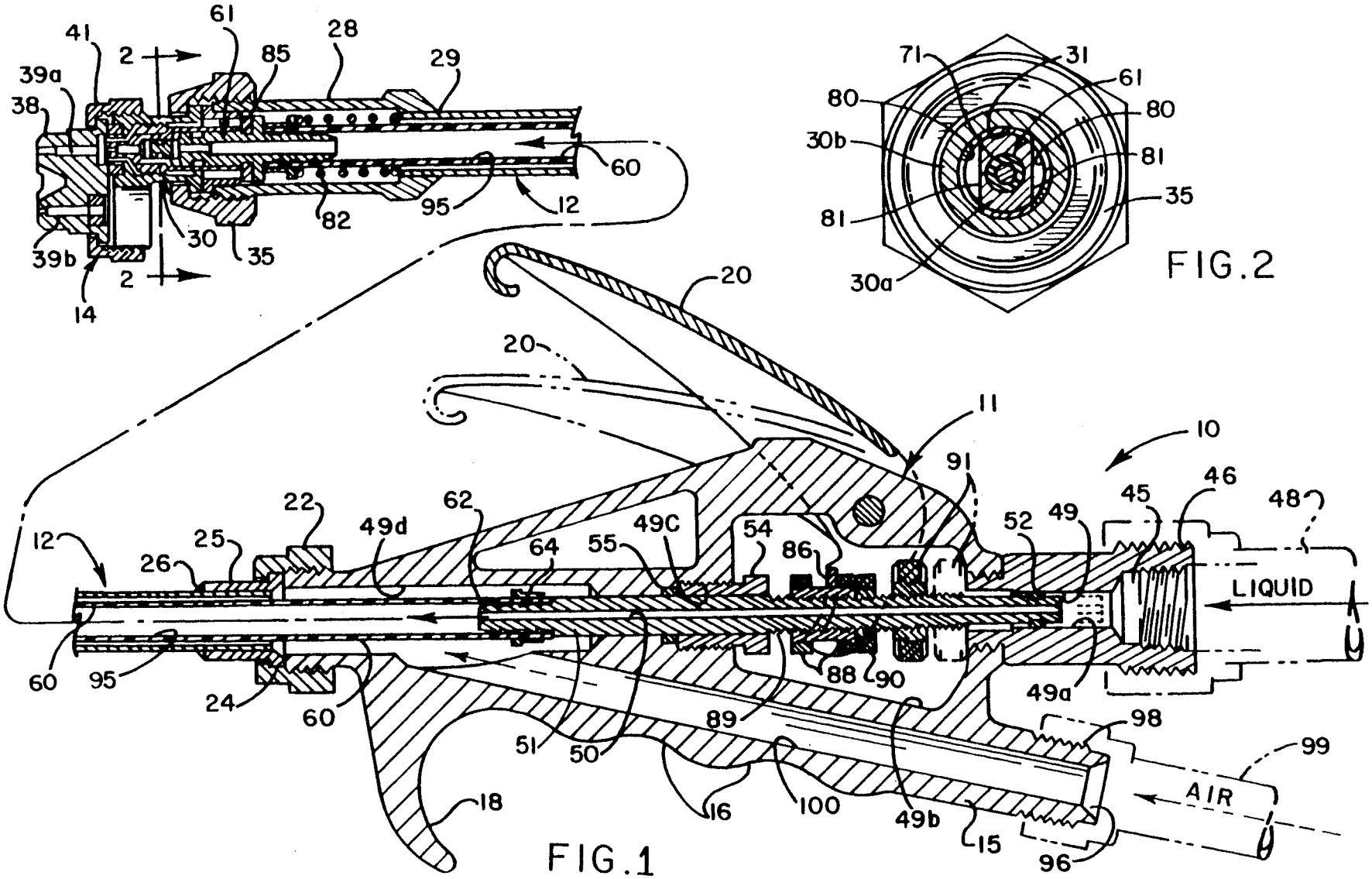
FIG. 1 is a vertical section, with a portion broken away, of an illustrative spray gun embodying the present invention.
FIG. 2 is an enlarged transverse section taken in the plane of line 2—2 in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to the drawings, there is shown an illustrative spray gun 10 embodying the present invention. The spray gun 10 basically comprises a body or handle section 11, an elongated tubular barrel section 12 in the form of a metallic tube extending forwardly of the body 11, and a nozzle section 14 supported forwardly of said barrel section 12. The body or handle section 11, which may be made of a brass forging or the like, includes a rearwardly and downwardly extending hand gripping portion 15 formed with finger-receiving undulations 16 and a downwardly curved hand guard 18 at the forward end thereof. A thumb or hand-engageable trigger 20 is pivotally mounted on an upper side of the body 11 for movement between a raised deactuated position, shown in solid lines, and a lowered actuating position shown in phantom lines.

For supporting the tube 12 on the handle section body 11, the forward end of the body 11 has an externally threaded hub 21 on to which a retaining cap 22 is secured. The retaining cap 22 engages an outwardly-extending, annular flange 24 of a farrow 25, which in turn is affixed in sealed relation to the rearward end of the tube 12, such as by soldering 26. Tightening up the retaining cap 22 onto the threaded hub 21 draws the rearward end of the farrow 24 into tight fitting, sealed engagement with the forward end of the body 11.

For supporting the nozzle section 14 forwardly of the tubular barrel section 12, an adaptor 28 is mounted on the end of the tube 14 in forwardly extending relation. The adaptor 28 is affixed to the tube 14 and is sealed with respect thereto, such as by soldering 29. A nozzle housing 30 comprising a pair of inner and outer sleeves **30*a*, 30*b*, respectively, is supported in forwardly extending relation to the adaptor 28. The inner and outer sleeves 30*a*, 30*b* are mountable in concentric relation, with the outer sleeve 30*b* having an internally-threaded, central section 31 that is engageable over an externally threaded central section of the inner sleeve 30*a* for drawing respective outwardly extending annular flanges 32*a*, 32*b*, of the sleeves 30*a*, 30*b* into tight abutting relation to each other. For securing the housing 30 in the adaptor 28, a retention cap 35 is threadedly engageable with an externally threaded forward end 36 of the adaptor 28 for tightly securing the annular flanges 32***a*, 32*b* of the sleeves 30*a*, 30*b* in sealed engagement with the forward annular end of the adaptor 28.

For enabling selective positioning of any of a plurality of discharge orifice configurations into operative position adjacent a discharge end of the gun 10 for effecting desired spray patterns, a multiple orifice spray tip 38 is supported forwardly of the nozzle housing 30. The spray tip 38 has a plurality of circumferentially spaced orifice configurations 39*a*, 39*b* each for generating a desired spray pattern, such as a flat spray pattern, conical spray pattern, or the like. The spray tip 38 is in the form an annular hub having an outwardly extending mounting flange 40 at a rear end thereof that is engageable by a retention cap 41. The retention cap 41 in this case engages an externally threaded, enlarged annular end portion 42 of the outer sleeve 30*b* of the nozzle housing 30. The cap 41 may be loosened to permit rotation of the nozzle tip 38 and positioning of the desired spray tip orifice 39*a*, 39*b* into operative position and retightened to securely retain the tip 38 against the end of the housing 30. The housing sleeve 30*b* is formed with an opening 44 in a lower portion thereof to permit access to the spray tip orifices 39*a*, 39*b* when in an inoperative position.

In accordance with an important aspect of the invention, the spray gun is selectively adapted for either air assisted or purely hydraulic spray operating modes and includes streamlined trigger actuated means for controlling operation of the gun without the necessity for complicated or cumbersome connecting cables and the like. More particularly, the gun has a liquid inlet at a rearward end thereof and is adapted to direct pressurized liquid in a straight longitudinal flow path through a relatively inexpensive plastic tube which functions both as a liquid conduit and as a means for moving a valve follower mechanism of the gun between open and closed conditions in response to actuation and deactuation of the trigger. To this end, the spray gun 10 has a liquid inlet 45 at a rearwardmost end of the handle section body 11. The body 11 in this case has an externally threaded hub 46 for receiving an adaptor of a liquid supply line 48, and the body 11 is formed with an internal cavity 49 extending from the liquid inlet 46 longitudinally through the handle section 11.

Liquid introduced into the inlet 45 communicates through a liquid flow passageway 50 in a stem 51 disposed within the body cavity 49, the upstream end of which is located within a section 49*a* of the body cavity 49 sized only slightly larger than the stem 51. The stem 51 is supported for relative longitudinal movement within the cavity 49, as will become apparent, and an annular seal 52 is interposed between the upstream end of the stem 51 and the cavity section 49*a* for movement with the stem 51. A central portion of the stem 51 is supported for relative longitudinal movement in a bushing 54 mounted in a threaded section 49*c* of the body cavity 49, and an annular seal 55 is provided between the body 11 and stem 51 immediately upstream thereof.

In keeping with the invention, an elongated conduit or tube 60, preferably made of plastic, is connected between the forward end of the stem 51 and a valve follower 61 for both communicating liquid through the gun and effecting movement of the valve follower 61 between actuating and deactuated positions in response to movement of the trigger 20. The plastic tube 60 in this case is positioned over a barbed forward end 62 of the stem and is secured thereto by a retention clamp 64 at a location within an enlarged cylindrical section 49*d* of the body cavity 49 downstream of the seal 55.

The forward end of the tube 60 is positioned over a barbed rear end 65 of the valve follower 61 and is similarly secured thereto by a tube clamp 66. The illustrated valve follower 61 has an outwardly extending annular flange 68 intermediate its ends, against which the tube clamp 66 is positioned. The valve follower 61 has a central liquid passageway 69 communicating at its upstream end with the liquid conduit tube 60. The valve follower passageway 69 has a reduced diameter nozzling section 69*a*, which communicates outwardly through radial passages 69*b* at a location upstream of a forward reduced diameter end 70 thereof. The valve follower 61 has "O"-rings 71, 72 disposed about the end 70 and a relatively larger diameter rearward portion 74 of the valve follower 61, respectively, for movement with the valve follower 61 and for sealing engagement with the valve housing 30, as will become apparent.

Figure 5:
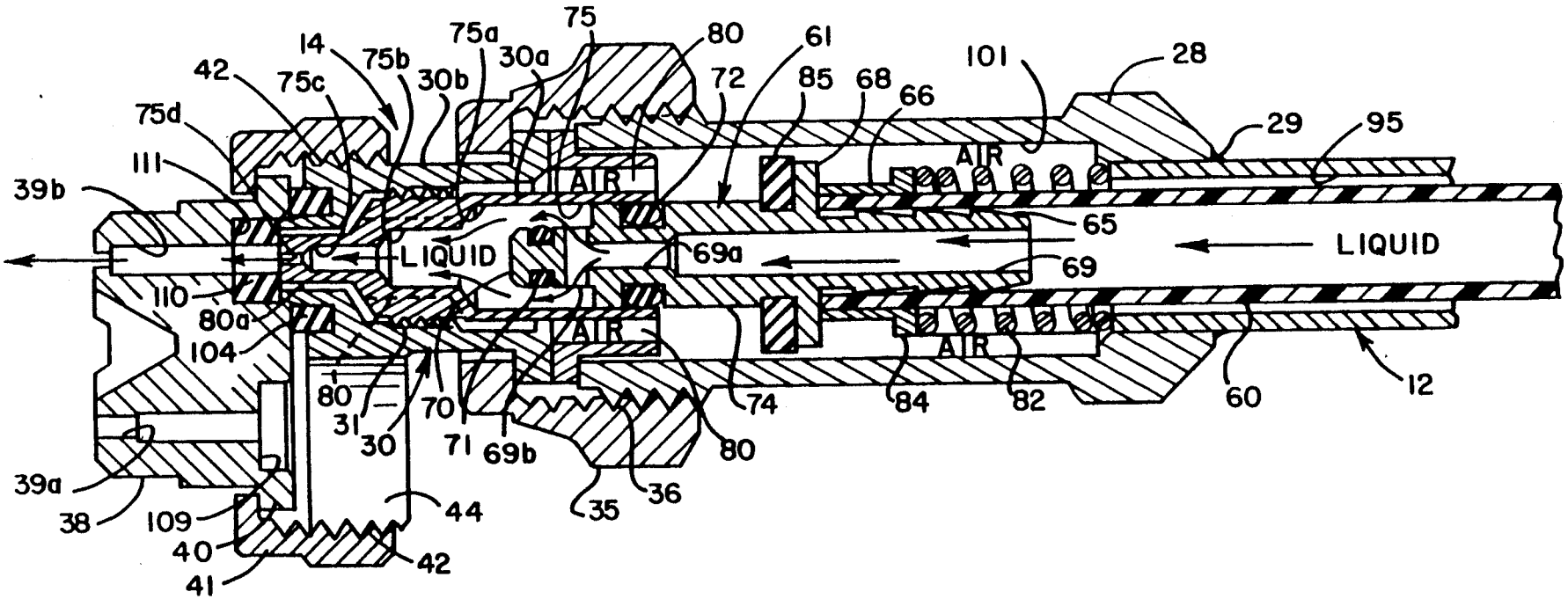
FIG. 5 is an enlarged fragmentary section, similar to FIGS. 3 and 4, showing the gun in a hydraulic operating mode.

The valve housing 30, in this case the inner sleeve 30*a* thereof, is formed with an internal chamber 75 extending axially therethrough. The chamber 75 has a large diameter portion 75*a* communicating with the upstream end thereof and sized to receive the relatively larger diameter portion 74 of the valve follower 61, and a reduced diameter chamber portion 75*b* forwardly thereof sized to receive the reduced diameter forward end 70 of the valve follower 61 (FIG. 5). The chamber portion 75*b* in turn communicates with a further reduced diameter liquid flow passageway 75*c*, which in turn communicates with a relatively small sized discharge orifice 75*d* of the valve housing 30 (FIG. 5).

The inner and outer sleeves 30*a*, 30*b* of the valve housing 30 further define a plurality of circumferentially spaced air passages 80 that extend axially through the valve housing 30. In order to permit communication of air through the threaded inter-engaging central sections 31 of the valve housing sleeves 30*a*, 30*b*, the inner sleeve 30*a* is formed with flats 81 that define a portion of the passages 80 communicating between upstream and downstream sides of the threaded sections (FIG. 2). The air passageways 80 extend inwardly downstream of the threaded section 31 and communicate with air discharge orifices 80*a* which extend longitudinally through the end of the valve housing 30 at circumferentially spaced locations about the liquid discharge orifices 75*d* of the valve housing 30.

Figure 3:
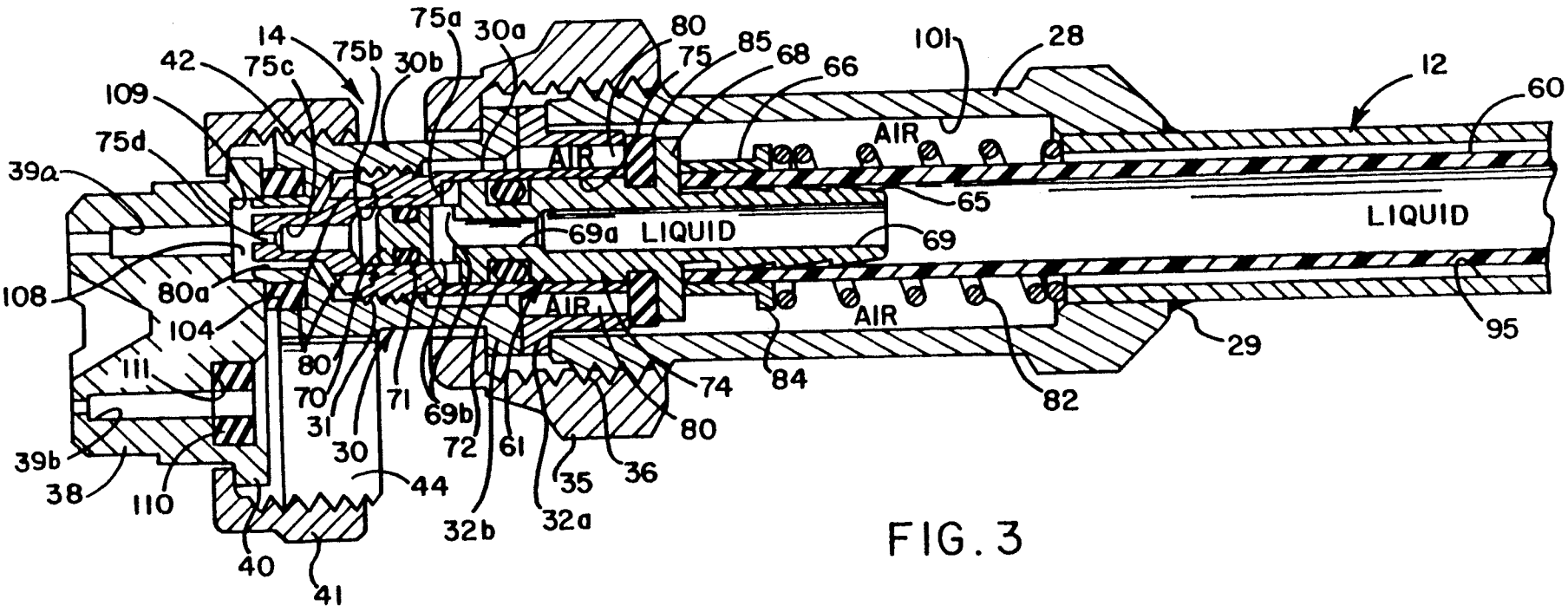
FIG. 3 is an enlarged fragmentary vertical section depicting the gun in an inoperative or shut-off condition.

For biasing the valve follower 61 toward a forwardmost closed position, as shown in FIG. 3, a coil spring 82 is disposed about a forward end of the liquid conduit tube 60 in interposed relation between an outwardly extending annular flange 84 of the tube clamp 66 and the forward end of the barrel section tube 12. In such closed position, the small diameter forward end 70 of the valve follower 61 is disposed within the chamber section 75*b* of the nozzle housing 30 with the "O"-ring 71 in sealed engagement therebetween to prevent forward liquid flow and with the "O"-ring 72 in sealed engagement with the chamber section 75*a* of the nozzle housing 30 to prevent backflow of liquid. At the same time, a cylindrical sealing member 85 mounted on the valve follower 61 adjacent the forward side of the flange 68 is forced against the end of the valve housing 30 closing the upstream ends of the nozzle housing air passageways 80.

Figure 4:
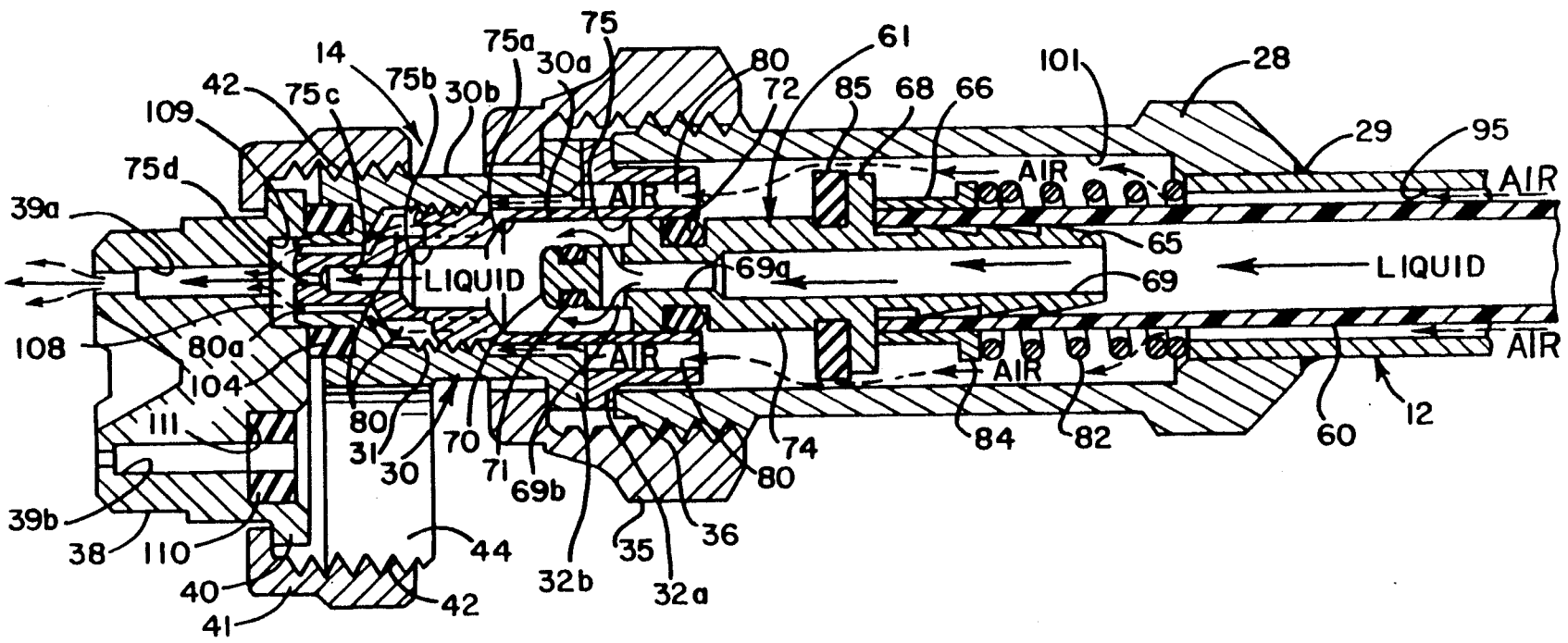
FIG. 4 is an enlarged vertical section, similar to FIG. 3, but showing the gun in an air atomizing operating mode.

In order to move the valve follower 61 from its closed position, shown in FIG. 3, to a retracted open position, as shown in FIG. 4, means are provided for moving the valve stem 50, the liquid conduit tube 60, and valve follower 61 connected thereto in a rearward direction in response to movement of the trigger 20 from its raised deactuated position, shown in solid lines in FIGS. 1, to its lowered actuating position, shown in phantom in FIG. 1. For this purpose, a follower arm 86 integrally formed on the trigger 20 extends at a substantial angle to the trigger inwardly into an enlarged central cavity section 49*b* of the body cavity 49. The trigger follow arm 86, which may have a yoke shaped terminal end disposed in straddling relation to the valve stem 50, is connected to a trigger guide 88 mounted on the stem 51 such that upon pivotal movement of the trigger 20 in a counterclockwise direction, as viewed in FIG. 1, the follower arm 86 will force the trigger guide 88 and the stem 50 in a rearward direction, with the liquid tube 60 and valve follower 61 following. As a result of such movement, the forward reduced diameter end 70 of the valve follower 61 is removed from the chamber section 75*b* nozzle housing 30 (FIG. 4) permitting the flow of liquid through the valve follower passageway 69, through the discharge orifice 75*d* of the valve housing 30, and through the selected nozzle tip orifice 39*a* positioned in axial alignment therewith (FIG. 4). At the same time, the seal 85 is moved rearwardly of the valve housing 30 opening the inlets to the air passageways 80. The trigger 20 preferably is sized appreciably greater than the follow arm 86 for providing sufficient leverage for ease of actuating movement.

In order to permit selective adjustment in the rearward stroke of the valve stem 50, and hence the valve follower 61 connected thereto, the valve guide 88 is mounted on a central threaded section 89 of the valve stem for rotative positioning thereon. For maintaining a setting of the valve guide 88 for a desired stroke of the valve follower 61, a lock nut 90 also is mounted on the threaded stem section 89 for positioning immediately adjacent a rear side of the valve guide 88. In order to prevent accidental actuation of the gun 10 during periods of non-use, a safety lock nut 91 is provided, which may be threadedly advanced into engagement with a rear wall of the body 11 defined by the enlarged cavity section 49*b*, as shown in phantom in FIG. 1, for preventing any movement of the valve stem 50.

In carrying out the invention, for enabling air atomized spraying, the liquid conduit tube 60 and barrel section tube 12 define an annular air passageway 95 for communicating pressurized air to the nozzle housing 30 air passages 80. The rearward end of the hand gripping portion 15 of the body 11 has an air inlet 96 with an externally threaded end 98 for receiving an adaptor of a pressurized air supply line 99. The air inlet 96 communicates through an air passageway 100 to the cylindrical cavity 49*d* of body 11 surrounding the upstream end of the liquid conduit 60, which in turn communicates with the annular air passage 95 defined between the liquid conduit tube 60 and the barrel sections tube 12. The annular air passage 95 in this case communicates with a chamber 101 defined by the adaptor 28, which in turn communicates with an upstream end of the valve housing 30.

Upon movement of the trigger 20 the actuating position shown in phantom in FIG. 1, as indicated above, it will be seen that the valve stem 50, the liquid conduit 60 and valve follower 61 are simultaneously moved in a rearward direction, causing the forward end 70 of the valve follower 61 move from its closed position with the "O"-ring 71 in sealed engagement with the valve housing chamber 75*b* to a location within the enlarged diameter chamber 75*a* of the valve housing 30, which enables liquid to flow outwardly through the radial valve follower passageways 69*b*, into the expansion area defined by the chamber 75*a* of the valve housing and to proceed through liquid passage 75*c* and discharge orifice 75*d* of the valve housing 30. At the same time, such rearward movement of the valve follower 61 causes the sealing member 85 to be moved rearwardly of the valve housing air passageways 80 inlets, permitting communication of pressurized air through the passageways 100, 49*d*, 95, 80 and out the discharge orifice 80*a* in the valve housing 30. In such retracted position, the annular "O"-ring 72, continues to sealingly engage the wall of nozzle housing chamber 75*a* and prevent backflow of the liquid. A cylindrical sealing member 104 is mounted in outwardly extending relation to the forward end of the valve housing 30 in surrounding relation about the liquid discharge orifice 75*d* and the air outlet orifices 80*a* for engaging the upstream end of the nozzle tip 38 and providing sealed communication between the housing orifices 75*d* and 80*b* and the operatively positioned spray tip orifice 39*a* (FIG. 4).

In keeping with a further aspect of the invention, the nozzle tip 38 and nozzle housing 30 define a relatively narrow depth expansion chamber 108 immediately downstream of the liquid and air discharge orifices 75*d*, 80*a* for permitting thorough atomization and liquid breakdown, with minimal air pressure requirements. The expansion chamber 108 in this instance is defined by a coaxial counterbore 109 in the upstream face of the nozzle tip 38. The counterbore 109 defines a mixing and expansion chamber having a diameter greater than the diametrical spacing of the air discharge orifices 80*a* and having a depth on the order of between about 0.20–0.30 of an inch. Such relatively narrow depth expansion chamber 108 tends to direct pressurized air flow from the discharge orifice 80*a* inwardly into impingement with the liquid flow stream from the liquid discharge orifice 75*d* such that relatively thorough liquid breakdown and atomization is achieved with pressures as low as 5 psi. The atomized liquid droplets proceed through the operatively positioned nozzle tip orifice 39*a* (FIG. 4) and discharges in the desired spray pattern.

In carrying out the invention, in order to permit spraying in a purely hydraulic mode, without pressurized air assisted atomization, one or more of the discharge orifices 39*b* in the nozzle tip 38 are provided with an annular sealing member 110 which is adapted, upon rotational positioning of the orifice 39*b* into operative position, for blocking the air discharge orifices 80*a* while permitting the liquid discharge through the nozzle housing orifice 75*d*. In the illustrated embodiment, the sealing member 110, which is of cylindrical configuration, is disposed within a counterbore 111 in the upstream face of the nozzle tip 38. The cylindrical sealing member 110 has a central opening, substantially the same as the diameter of the liquid flow passage 39*b* in the nozzle tip 38, but in this case substantially larger than the liquid discharge orifice 75*d* of the nozzle housing. The internal flow passageway of the sealing member 110 is of lesser diameter than the diametrical spacing of the discharge orifices 80*a* of the nozzle housing so that rotational positioning of the nozzle tip orifice 39*b*, from the inoperative position shown in FIG. 4, to an operative position shown in FIG. 5, the cylindrical sealing member 110 is engageable against the ends of air discharge orifices 80*a*. Upon secure clamping of the nozzle tip 38 onto the nozzle housing 30 by the retainer cap 41, the sealing member 110 is forcefully presented against the nozzle housing to block air flow from the discharge orifices 80*a*. Hence, upon actuation of the trigger 20, pressurized air flow through the nozzle housing 30 discharge orifices 80*a* is blocked without the necessity for deactuating the pressurized air supply, thereby enabling the gun to be easily operated in a purely hydraulic spraying mode.

In keeping with still a further aspect of the invention, the handle section 11, barrel section 12, nozzle section 14, and the nozzle tip 38 may be easily disassembled from each other for field service and repair by unscrewing of any of the three retention caps 22, 35, 41. Likewise, if spraying applications dictate a longer barrel section 12, the gun may be reconfigured by substitution of a different length barrel 12 and liquid conduit tube 60.

From the foregoing, it can be seen that while the hand held spray gun of the present invention may be operated in either air assisted or purely hydraulic spraying modes, it has a relatively simple, streamlined configuration which allows for economical manufacture and easy field service. The gun further is adapted for air assisted spray operation at relatively low pressures so as to minimize repressurization of the liquid containing pressure tank with which the gun is used.

What is claimed is:

1. A hand-held spray gun comprising a handle section having a liquid inlet, a nozzle section mounted forwardly of said handle section and having a discharge orifice, said nozzle section including a nozzle housing and a valve follower, liquid conduit means connected to said valve follower and extending to said handle section for communicating liquid from said inlet to said nozzle section, a trigger mounted on said handle section for movement between actuating and deactuating positions, said trigger being operatively coupled to said liquid conduit means such that upon movement of said trigger from said deactuating to said actuating positions said liquid conduit means and the valve follower connected thereto are moved from a first position in which said valve follower prevents the flow of liquid through said nozzle section discharge orifice to a second position which permits the flow of liquid from said liquid inlet and through said liquid conduit means and nozzle section discharge orifice.

2. The spray gun of claim 1 in which said valve follower has a liquid passageway communicating with said liquid conduit means, and upon movement of said trigger to said actuating position liquid is directed from said inlet through said liquid conduit means, valve follower passageway and nozzle section discharge orifice.

3. The spray gun of claim 1 in which said liquid conduit means is a plastic tube.

4. The spray gun of claim 1 in which said liquid conduit means is a tube extending in a substantially straight line from said liquid inlet to said valve follower.

5. The spray gun of claim 1 in which said liquid inlet, liquid conduit means, and said nozzle section discharge orifice have axes on a substantially straight line.

6. The spray gun of claim 1 in which said nozzle section is supported forwardly of said handle section by an elongated barrel section, and said liquid conduit means extends from said valve follower through said barrel section.

7. The spray gun of claim 6 in which said handle section includes a pressurized air supply inlet, said liquid conduit means and barrel section defining a first air passageway communicating at one end with said pressurized air inlet and at another end with said nozzle housing, said nozzle housing being formed with an air passageway, and said follower being operable in response to movement of said liquid conduit and valve follower from said first position to said second position for permitting communication of air from said pressurized air inlet through said first air passageway and said nozzle housing air passageway for assisting in atomizing liquid directed through said discharge orifice.

8. The spray gun of claim 7 in which said barrel section includes an elongated metallic tube, said liquid conduit means being a plastic tube, and said first air passageway is an annular flow path defined by space between said barrel section tube and said plastic tube.

9. The spray gun of claim 6 including resilient means for biasing said valve follower and liquid conduit means toward said first position.

10. The spray gun of claim 9 in which said biasing means includes an annular spring surrounding a forward end of said liquid conduit means in interposed relation between said valve follower and a forward end of said barrel section.

11. The spray gun of claim 10 in which said liquid conduit means includes a stem disposed within said handle section, and a plastic tube connected between a forward end of said stem and said valve follower, and means operatively coupling said trigger to said stem.

12. The spray gun of claim 11 including means for selectively connecting said trigger to said stem for establishing a desired stroke of movement of said stem, plastic tube, and valve follower from said first position to said second position.

13. The spray gun of claim 12 in which said stem includes an externally threaded section, a threaded collar rotatably positionable on said threaded section, and means connecting said collar to said trigger.

14. The spray gun of claim 13 including a lock nut means on said threaded stem section, said lock nut means being rotatable on said threaded stem section for positioning to a locking location which prevents movement of said valve stem, liquid conduit, and follower.

15. The spray gun of claim 6 including means removably securing said handle section, barrel section and nozzle section together.

16. The spray gun of claim 1 including a spray tip which defines said nozzle section discharge orifice, said spray tip having a plurality of discharge orifices, and means for adjustably mounting said spray tip with a selected one of said spray tip discharge orifices in an operative position for establishing a desired spray pattern discharge from said gun.

17. The spray gun of claim 15 in which said handle section includes a pressurized air supply inlet, means defining an air passageway between said air supply inlet and said nozzle housing, said nozzle housing defining a central liquid discharge orifice and an air discharge orifice adjacent said liquid discharge orifice, an annular sealing member surrounding said nozzle housing liquid and air discharge orifices in interposed relation between said spray tip and nozzle housing upon positioning of a selected spray tip orifice into operative position for establishing sealed communication between said nozzle housing liquid and air orifices and said operatively positioned spray tip orifice.

18. The spray gun of claim 17 in which said annular sealing member is supported forwardly of said nozzle housing.

19. The spray gun of claim 17 in which said spray tip and housing define a mixing and expansion chamber into which said nozzle housing liquid and air discharge orifices communicate for enhancing breakdown and atomization of liquid prior to direction through said operatively positioned spray tip discharge orifice.

20. The spray gun of claim 19 in which said expansion chamber has a depth of about 0.10 inches and a width encompassing said nozzle housing liquid and air discharge orifices.

21. The spray gun of claim 17 in which said nozzle housing defines a plurality of air discharge orifices disposed in circumferentially spaced surrounding relation to said nozzle housing liquid discharge orifice.

22. The spray gun of claim 21 in which said spray tip includes an annular sealing member surrounding the upstream end of at least one of said spray tip orifices, and upon positioning of said one spray tip orifice into said operative position said nozzle tip sealing member is engageable with said nozzle housing air discharge orifices to block the discharge of pressurized air therethrough thereby enabling the gun to operate in a hydraulic non-air assisted spraying mode.

23. The spray gun of claim 1 in which said valve follower includes a forward reduced diameter end and a relatively larger diameter portion rearwardly thereof, and said valve follower being formed with a longitudinal liquid passageway communicating with an upstream end thereof and with said liquid conduit means connected thereto, and said valve follower longitudinal liquid passageway communicating with at least one radial passageway extending radially outwardly through said forward reduced diameter end.

24. The spray gun of claim 23 in which said nozzle housing defines a first relatively small diameter chamber adjacent a downstream end thereof for receiving said forward reduced diameter end of said valve follower and preventing the discharge of liquid through said at least one radial passageway and a second relatively larger diameter chamber rearwardly thereof for receiving said second relatively larger diameter portion of said follower, means for biasing said valve follower toward a first position in which said reduced diameter forward end thereof is positioned within said first nozzle housing chamber and passage of liquid through said valve follower radial passageway is blocked, and means responsive to movement of said trigger to said actuating position for moving said valve follower to a second position in which said forward reduced diameter end is removed from said first nozzle housing chamber and is positioned in said second relatively larger nozzle housing chamber for permitting the passage of liquid through said at least one radial passageway, said second and first nozzle housing chambers and said discharge orifice.

25. The spray gun of claim 24 in which said valve follower has first and second annular sealing members disposed respectively about the outer perimeter thereof on opposite downstream and upstream sides of said at least one radial passageway for engaging said nozzle housing when said valve follower is in said first position.

26. The spray gun of claim 25 in which said first annular sealing member is disposed about said reduced diameter forward end of said valve follower for engagement with the walls of said first nozzle housing chamber when said valve follower is in said first position and said second annular sealing member is disposed about said relatively larger diameter portion of said valve follower on an upstream side of said at least one radial passageway for engagement with the wall of said second nozzle housing chamber.

27. The spray fun of claim 1 in which said handle section includes a pressurized air supply inlet, means defining an air passageway between said air inlet and said nozzle housing, said nozzle housing defining an air flow passage communicating between upstream sides of said nozzle housing, said valve follower including an annular sealing member which is in sealing engagement with the upstream side of said valve nozzle housing and covering said air passage when said valve follower is in said first position for blocking communication of pressurized air into said air passage.

28. The spray gun of claim 27 in which said liquid inlet is at a rear of said handle section, and said pressurized air inlet is disposed below said liquid inlet.

29. The spray gun of claim 28 in which said handle section includes a body which defines said liquid inlet and said pressurized air inlet, and said body having a lower hand gripping portion located with an air passageway communicating with said air inlet.

30. The spray gun of claim 1 in which said nozzle housing includes a pair of threadedly engaged inner and outer sleeves.

31. The spray gun of claim 30 in which said outer sleeve of said nozzle housing is formed with an enlarged annular end portion, said nozzle section including a spray tip, and a retention cap for releasably securing said nozzle tip to said enlarged annular end portion.

32. The spray gun of claim 31 in which said spray tip is formed with a plurality of discharge orifices for selective location in an operative position, said enlarged annular sleeve end portion being formed with an aperture in a lower part thereof for permitting access to said spray tip orifices when not in an operative position.

33. A hand-held spray gun comprising a handle section having a liquid inlet and a pressurized air inlet, a barrel section including an elongated tube mounted forwardly of said handle section, a nozzle section mounted at a forward end of said barrel section, said nozzle section having a spray discharge orifice, liquid conduit means in said barrel section tube for communicating liquid from said liquid inlet to said nozzle section, said barrel tube and liquid conduit means defining an air passageway through said barrel section communicating between said pressurized air inlet and said nozzle section, a trigger mounted on said handle section for movement between a deactuating position and an actuating position, said nozzle section including a nozzle housing and a valve follower, said nozzle housing having a liquid passage and an air passage, and said valve follower being operable in response to movement of said trigger from said deactuating position to said actuating position for permitting communication of liquid from said liquid inlet through said liquid conduit means and nozzle housing liquid passage and out said nozzle section discharge orifice and for permitting the communication of air from said pressurized air inlet and through said barrel section air passageway, nozzle housing air passage and nozzle section discharge orifice whereby an air assisted, atomized liquid spray is discharged from said nozzle section discharge orifice.

34. The spray gun of claim 33 in which said liquid inlet, liquid conduit means, and nozzle section discharge orifice are on a substantially straight line.

35. The spray gun of claim 34 in which said liquid inlet is located on a rear end of said handle section and said pressurized air inlet is located at a location below said liquid inlet.

36. The spray gun of claim 33 including a spray tip which defines said nozzle section discharge orifice, said spray tip having a plurality of discharge orifices, means for adjustably mounting said spray tip with a selected one of said discharge orifices in an operative position with respect to said nozzle housing liquid passage for establishing a desired discharging spray pattern from said gun, and an annular sealing member surrounding said nozzle housing liquid and air passages in interposed relation between said spray tip and housing upon positioning of a selected spray tip orifice into operative position for establishing sealed communication between said nozzle housing liquid and air passage and said operatively positioned spray tip orifice.

37. The spray gun of claim 36 in which said spray tip and nozzle housing define a mixing and expansion chamber into which said nozzle housing liquid and air passages communicate for enhancing breakdown and atomization of liquid prior to direction through said operatively positioned spray tip discharge orifice.

38. The spray gun of claim 37 in which said expansion chamber has a depth of about 0.10 inches and a width encompassing said nozzle housing liquid and air discharge passages.

39. The spray gun of claim 37 in which said spray tip includes an annular sealing member surrounding the upstream end of at least one of said spray tip orifices, and upon positioning of said at least one spray tip orifice into said operative position said spray tip sealing member is engageable with said nozzle housing air passage to block the discharge of pressurized air therethrough thereby enabling the gun to operate in a hydraulic non-air assisted spraying mode.

40. The spray gun of claim 33 including means removably securing said handle section, barrel section and nozzler section together.

41. The spray gun of claim 40 in which said means removably securing includes a first threaded retention cap for securing said barrel section to said handle section and a second threaded retention cap for securing said nozzle section to said barrel section.

42. A hand-held spray gun comprising a handle section having a liquid inlet, a nozzle section mounted forwardly of said handle section, said nozzle section including a spray tip, a nozzle housing adjacent a downstream end of said gun, and a valve follower disposed adjacent said nozzle housing, said nozzle housing having a liquid flow passage with a discharge orifice on a downstream end thereof and at least one air flow passage with an air discharge orifice in adjacent relation to said liquid discharge orifice, said spray tip having a plurality of spray orifices, means for adjustably mounting said spray tip on said nozzle housing with a selected one of said spray orifices in operative position aligned with said nozzle housing liquid discharge orifice, liquid conduit means communicating between said liquid inlet and an upstream end of said nozzle housing, pressurized air flow passage means communicating between said pressurized air inlet and an upstream end of said nozzle housing, a trigger mounted on said housing for actuating movement between actuating and deactuating positions, and said valve follower being movable in response to actuating movement of said trigger from a first position at which said valve follower simultaneously prevents direction of pressurized air and liquid through said operatively aligned spray tip orifice from said nozzle housing air and liquid passages respectively to a second position which permits communication of liquid to said operatively aligned spray orifice from said liquid inlet, liquid conduit means, and nozzle housing liquid passage and simultaneously permits the communication of pressurized air from said air inlet through said air flow passage means, and nozzle housing air passage whereby an air assisted atomized liquid spray is discharged from said operatively aligned spray tip discharge orifice.

43. A hand-held spray gun comprising a handle section having a liquid inlet, a nozzle section mounted forwardly of said handle section, said nozzle section including a spray tip, a nozzle housing, and a valve follower, said nozzle housing having a liquid flow passage with a discharge orifice on a downstream and thereof and at least one air flow passage with an air discharge orifice in adjacent relation to said liquid flow passage discharge orifice, said spray tip having a plurality of spray orifices, means for adjustably mounting said spray tip on said nozzle housing with a selected one of said spray orifices in operative position aligned with said nozzle housing liquid flow passage discharge orifice, liquid conduit means communicating between said liquid inlet, and an upstream end of said nozzle housing, said liquid inlet, liquid conduit means, and nozzle housing liquid flow passage discharge orifice being in a substantially straight line, means defining a pressurized air inlet, pressurized air flow passage means communicating between said pressurized air inlet and an upstream end of said nozzle housing, a trigger mounted on said housing for actuating movement between actuating and deactuating positions, and said valve follower being movable in response to actuating movement of said trigger from a first position which prevents direction of pressurized air and liquid through said operatively aligned spray tip orifice from said nozzle housing liquid passage and said at least one air passage to a second position which permits communication of liquid to said operatively aligned spray tip orifice from said liquid inlet, liquid conduit means, and nozzle housing liquid passage and which permits the communication of pressurized air from said air inlet, air flow passage means, and said at least one nozzle housing air passage whereby an air assisted atomized liquid spray is discharged from said operatively aligned spray tip orifice.

44. A hand-held spray gun comprising a handle section having a liquid inlet, a nozzle section mounted forwardly of said handle section, said nozzle section including a spray tip, a nozzle housing, and a valve follower, said nozzle housing having a liquid flow passage with a discharge orifice on a downstream end thereof and at least one air flow passage with an air discharge orifice in adjacent relation to said liquid discharge orifice, said spray tip having a plurality of spray orifices, means for adjustably mounting said spray tip on said nozzle housing with a selected one of said spray tip orifices in operative position aligned with said nozzle housing liquid flow passage discharge orifice, liquid conduit means communicating between said liquid inlet and an upstream end of said nozzle housing, means defining a pressurized air inlet, pressurized air flow passage means communicating between said pressurized air inlet and an upstream end of said nozzle housing, a trigger mounted on said housing for actuating movement between actuating and deactuating positions, said valve follower being movable in response to actuating movement of said trigger from a first position which prevents direction of pressurized air and liquid through said operatively aligned spray tip orifice from said valve housing liquid passage and said at least one air flow passage to a second position which permits communication of liquid to said operatively aligned spray tip orifice from said liquid inlet, liquid conduit means, and valve housing liquid passage and which permits the communication of pressurized air from said air inlet, air flow passage means, and said at least one nozzle housing air passage whereby an air assisted atomized liquid spray is discharged from operatively spray tip discharge orifice, and said spray tip and nozzle housing defining a mixing and expansion chamber into which said nozzle housing liquid flow passage and said at least one air flow passage communicate for enhancing breakdown and atomization of liquid prior to direction through said operatively positioned spray tip orifice.

45. A hand-held spray gun comprising a handle section having a liquid inlet, a nozzle section mounted forwardly of said handle section, said nozzle section including a spray tip, a nozzle housing, and a valve follower, said nozzle housing having a liquid flow passage with a discharge orifice on a downstream end thereof and at least one air flow passage with an air discharge orifice in adjacent relation to said liquid flow passage discharge orifice, said spray tip having a plurality of spray orifices, means for adjustably mounting said spray tip on said nozzle housing with a selected one of said spray tip orifices in operative position aligned with said nozzle housing liquid flow passage discharge orifice, liquid conduit means communicating between said liquid inlet and an upstream end of said nozzle housing, means defining a pressurized air inlet, pressurized air flow passage means communicating between said pressurized air inlet and an upstream end of said nozzle housing, a trigger mounted on said housing for actuating movement between actuating and deactuating positions, said valve follower being movable in response to actuating movement of said trigger from a first position which prevents direction of pressurized air and liquid through said operatively aligned spray tip orifice from said valve housing liquid passage and said at least one air flow passage to a second position which permits communication of liquid to said operatively aligned spray orifice from said liquid inlet, liquid conduit means, and spray housing liquid passage and which permits the communication of pressurized air form said air inlet, air flow passage means, and said at least one valve nozzle housing air passage, and said spray tip including an annular sealing member surrounding the upstream end of at least one of said spray tip orifices, and upon positioning of said at least one nozzle tip orifice into said operative position said spray tip sealing member is engageable with said nozzle housing to block the discharge of pressurized air therethrough thereby enabling the gun to operate in a hydraulic non-air assisted spraying mode.

* * * * *